US007748685B2

(12) United States Patent
Richards

(10) Patent No.: US 7,748,685 B2
(45) Date of Patent: Jul. 6, 2010

(54) WINCH ASSEMBLY

(75) Inventor: Andrew Richards, Aberdeenshire (GB)

(73) Assignee: Expro North Sea Limited, Aberdeen (GB)

( * ) Notice: Subject to any disclaimer, the term of this patent is extended or adjusted under 35 U.S.C. 154(b) by 206 days.

(21) Appl. No.: 11/660,770

(22) PCT Filed: Aug. 26, 2005

(86) PCT No.: PCT/GB2005/003357

§ 371 (c)(1),
(2), (4) Date: Jan. 25, 2008

(87) PCT Pub. No.: WO2006/027553

PCT Pub. Date: Mar. 16, 2006

(65) Prior Publication Data

US 2008/0265226 A1 Oct. 30, 2008

(30) Foreign Application Priority Data

Sep. 7, 2004 (GB) ..... 0419781.0

(51) Int. Cl.
*B66F 1/00* (2006.01)

(52) U.S. Cl. ..... 254/385; 254/335; 242/157.1; 242/615; 242/397.3; 242/397.2; 242/548.1

(58) Field of Classification Search ..... 254/385, 254/335; 242/157.1, 397.3, 548.1, 615, 615.1, 242/397.2

See application file for complete search history.

(56) References Cited

U.S. PATENT DOCUMENTS

| | | | | |
|---|---|---|---|---|
| 798,635 | A * | 9/1905 | Stevenson | 254/272 |
| 1,198,122 | A * | 9/1916 | Golden | 182/142 |
| 1,950,288 | A * | 3/1934 | Benson | 182/142 |
| 2,385,939 | A * | 10/1945 | Pollock | 242/157.1 |
| 3,889,896 | A * | 6/1975 | O'Hara | 242/386 |
| 4,334,670 | A | 6/1982 | Kawabe | |
| 5,927,693 | A * | 7/1999 | Hackl | 254/398 |
| 6,443,431 | B1 * | 9/2002 | Stasny et al. | 254/385 |
| 6,983,927 | B2 * | 1/2006 | Pelletier et al. | 254/385 |

(Continued)

FOREIGN PATENT DOCUMENTS

DE 35 39 884 A1 5/1987

(Continued)

*Primary Examiner*—Emmanuel M Marcelo
(74) *Attorney, Agent, or Firm*—Tarolli, Sundheim, Covell & Tummino LLP

(57) ABSTRACT

A winch assembly (10) comprises a winch drum (18) rotatable about a first axis and carrying a spoolable medium, such as wireline (14) for use in deploying and retrieving tooling into and from a well bore. A carriage sheave (30) mounted on a drive screw (34) is positioned adjacent the winch drum (18), wherein the drive screw (34) is rotatable about a second axis substantially parallel to the first axis. In use, the carriage sheave (30) engages the spoolable medium and is translated by the drive screw (34) in reverse directions to follow the fleeting motion of the spoolable medium as the medium is paid out and/or in from the winch drum (18). In a disclosed embodiment, the winch drum (18) is mounted vertically on a tubular body (22), through which tubular body (22) the spoolable medium extends into the well bore. In one embodiment the winch assembly (10) forms part of a subsea well intervention system.

30 Claims, 1 Drawing Sheet

U.S. PATENT DOCUMENTS

| | | | | |
|---|---|---|---|---|
| 2004/0069981 | A1 * | 4/2004 | Pelletier et al. | 254/385 |
| 2006/0208246 | A1 * | 9/2006 | Britten | 254/385 |

FOREIGN PATENT DOCUMENTS

| | | | |
|---|---|---|---|
| DE | 35 39 884 | C2 | 12/1988 |
| DE | 38 32 192 | A1 | 1/1989 |
| WO | WO 2004/065757 | A2 | 8/2004 |
| WO | WO 2004/065757 | A3 | 8/2004 |

* cited by examiner

WINCH ASSEMBLY

FIELD OF INVENTION

The present invention relates to a winch assembly, and particularly, but not exclusively, to a winch assembly for use in, for example, subsea wireline intervention applications.

BACKGROUND TO INVENTION

In the oil and gas exploration and production industry many well operations require the use of tools which are deployed (and in some cases operated/controlled) into a well on wireline, such as electrically conducting wireline or non-conducting slickline or the like. Conventional wireline may comprise single or multi-strand steel cable, or alternatively may be formed of a composite material. Wireline operations may include well intervention procedures such as well logging to establish wellbore and formation conditions of a depleting well, or remedial operations, such as re-perforating and water shutoff, for instance. For example, a well fluid collecting/sampling tool may be deployed to formation depth on the end of a length of slickline which is translated by use of a winch system located at surface level.

A winch system for use with wireline typically includes a drum upon which the wireline is spooled in suitably pitched coils, as conventionally known in the art. A motor and braking system may be utilised to rotate and control the drum in either direction to deploy or retrieve a suitable tool coupled to the end of the wireline. It is possible, however, for the wireline to become jammed or entangled as it is paid out, due to the pitch of the coils and the fleeting motion of the wireline along the length of the drum. Jamming of the wireline in this manner may be minimised by, for example, maintaining a small maximum angle of fleet between the wireline and a wireline pulley system or initial lubricator tube or the like. However, due to the size of the winch, a small angle of fleet would typically only be achieved by locating the pulley system or lubricator or the like far removed from the drum, which may be impractical on offshore operations where space is at a premium, or where the winch system must be located with or on a subsea production system. Furthermore, it is essential that as the wireline is paid in, the pitch of the coils is maintained to prevent jamming of the winch system and to ensure that the wireline can be fully paid in to retrieve a tool from a well bore.

The past decade has seen the use of subsea production systems become the method of choice for exploiting offshore oil and gas fields. In the formative era of subsea production systems, it was envisaged that intervention operations would be conducted from a drilling rig or ship via a marine riser and Blow Out Preventer (BOP). However, the present Applicant has proposed the use of a self-contained well intervention system which can be deployed from a lightweight vessel and coupled directly to a wellhead, which offers significant advantages. Such a self-contained well intervention system is disclosed in Applicant's International Patent Application No. WO2004/065757. It is essential that the equipment utilised in such a self-contained intervention system be of a quality such that system integrity is not compromised, which would otherwise require continual retrieval and overhaul for maintenance and repair. It is therefore deemed essential that any wireline winching apparatus forming part of a self-contained intervention system is prevented from failure by seizing or jamming, particularly as the winching system may be exposed to wellbore pressures.

It is among the objects of the present invention to obviate or at least mitigate one or more of the disadvantages and problems noted above.

SUMMARY OF INVENTION

According to a first aspect of the present invention, there is provided a winch assembly for use with a spoolable medium, said assembly comprising:

a winch drum rotatable about a first axis and adapted to carry a spoolable medium, the winch drum being adapted to be coupled to drive means for rotatably driving the winch drum to spool the spoolable medium;

a drive screw rotatable about a second axis aligned substantially parallel with the first axis; and a carriage sheave mounted on the drive screw and adapted to be translated by the drive screw axially therealong, said carriage sheave further adapted to engage the spoolable medium, the drive screw being adapted to be coupled to drive means for rotatably driving the drive screw to translate the carriage sheave therealong.

Preferably, the winch assembly includes drive means.

Preferably, the carriage sheave is adapted to be translated along the length of the drive screw in both directions. The direction of travel of the carriage sheave may be reversed by use of a reversible drive means. In this arrangement, the drive screw may define a single helix male thread which engages a corresponding single helix female thread formed within the carriage sheave.

In an alternative and preferred embodiment of the present invention, reversal of the direction of travel of the carriage sheave may be permitted by the provision of a double helix screw thread formed on the drive screw which engages a suitably formed follower mechanism provided with the carriage sheave, as is known in the art. In this way, the carriage sheave may be translated along the drive screw in opposing directions while the drive means and drive screw are continually operated or rotated in a single direction.

In use, the carriage sheave engages the spoolable medium and is caused to be translated along the drive screw such that the carriage sheave follows the fleeting motion of the spoolable medium as the medium is paid out and/or in from the winch drum. Accordingly, the winch assembly, in operation, permits the spoolable medium to continually exit the winch drum at an angle which is substantially perpendicular to the axis of rotation of the drum, providing an effective fleet angle of 0°, thus minimising the possibility of the spoolable medium becoming jammed or entangled, and permitting the spoolable medium to be properly wound onto the winch drum.

Preferably, the drive means is adapted to rotate the drive screw at a rate proportional to the rotation of the winch drum. Preferably, the proportional rate of rotation of the drive screw is such that the carriage sheave is caused to be translated at a linear velocity substantially equal to the fleeting rate of the spoolable medium along the length of the winch drum; the fleeting rate will be dictated by the speed of rotation of the winch drum and the pitch spacing of the spoolable medium on the drum.

Advantageously, the drive means may comprise a motor coupled to the drive screw, and a separate motor coupled to the winch drum, wherein a control system is provided to maintain the drive screw motor at the required speed by monitoring the speed of the winch drum motor.

Alternatively, and in a preferred embodiment of the present invention, the drive means is a drive system comprising a single motor drivingly coupled to the winch drum. The motor may be an electric drive motor or hydraulic drive motor or the like. Advantageously, the motor may be drivingly coupled to the winch drum via a suitable gearing mechanism, and preferably a gear reduction mechanism. Preferably, the drive means further comprises a geared connection between a winch drum and the drive screw of the present invention, such that the drive screw is directly driven by the winch drum. Preferably, the geared connection comprises a fixed ratio gear train such that the rotational speed of the drive screw is continually proportional to the rotational speed of the winch drum. Preferably, the geared connection comprises directly meshing gear wheels. Alternatively, or additionally, the geared connection may comprise a chain drive or a belt drive or the like.

Preferably, the winch assembly further comprises a secondary drive means which may be operated as a back-up system.

Preferably, the carriage sheave is adapted to engage the spoolable medium via a guide portion. Advantageously, the guide portion may comprise at least one and preferably a plurality of rolling bodies to act as a bearing surface over which the spoolable medium runs. The rolling bodies may be ball bearings or rollers or the like. Beneficially, the guide portion may be adapted to deflect the spoolable medium. Advantageously, the guide portion may be adapted to deflect the spoolable medium through, for example, 0 to 180°, and preferably around 90°.

Preferably, the carriage sheave is mounted on the drive screw so as to be freely rotatable about the second axis such that the carriage may accommodate any changes in the relative inclination angle of the spoolable medium as it extends from the winch drum, which will vary as the spoolable medium in paid in and out. Alternatively, the carriage sheave may be prevented from rotating about the second axis. The carriage sheave may comprise a wide spoolable medium guide portion or a V-shaped spoolable medium guide. A wide or v-shaped spoolable medium guide is particularly useful if the carriage sheave is prevented from rotating about the second axis in accommodating variations in the inclination angle of the spoolable medium.

The winch assembly may be suitable for use at surface level, for example, on an offshore rig or intervention vessel or the like.

In a preferred embodiment, the winch assembly is adapted for use within a subsea intervention system.

Advantageously, the winch assembly further comprises a pressure retaining enclosure, within which enclosure at least the winch drum, drive screw and carriage sheave are mounted. Advantageously, the pressure retaining enclosure is adapted to be connected to a wellhead such that the spoolable medium may be extended from the winch assembly to the wellhead, and into a wellbore, for example to deploy tools, such as intervention tools therein. The spoolable medium may extend between the pressure retaining enclosure and the wellhead via one or more lubricator tubes. Preferably, the pressure retaining enclosure is adapted to be exposed to and retain wellbore pressures. Preferably, the pressure retaining enclosure forms part of a subsea intervention system.

Preferably, the winch assembly further comprises a slip ring/collector which is advantageously provided between the winch drum and a pressure retaining enclosure to allow continuous communication of electrical signals, for example between a conducting spoolable medium and an external control/data system.

Preferably, the winch assembly is adapted to be positioned in a vertical position such that the first and second axes are substantially vertical. Advantageously, the winch drum may be adapted to be mounted on a tubular body which defines a throughbore extending towards a wellhead and through which the spoolable medium may extend from the winch drum and into the wellbore. Accordingly, this arrangement may permit more efficient use of space, particularly where the winch assembly is for use with or forms part of a subsea intervention system.

Advantageously, the winch drum defines spiral grooves on a barrel surface thereof to ensure correct spooling of the spoolable medium. Conveniently, the winch drum may be adapted to accommodate a variety of spoolable media. The spoolable medium may be, for example, slickline, braided line or some form of composite cable or the like. Advantageously, the winch drum may be utilised with a spoolable medium with a diameter up to 5.56 mm (7/32") with a capacity of, for example, 7620 meters (25,000 ft).

According to a second aspect of the present invention, there is provided a winch spooling assembly comprising:

a drive screw;

a carriage sheave mounted on the drive screw and adapted to be translated by the drive screw axially therealong, said carriage sheave further adapted to engage a spoolable medium, the drive screw being adapted to be coupled to drive means for rotatably driving the drive screw to translate the carriage sheave therealong.

Preferably, the winch spooling assembly includes drive means.

Preferably, the carriage sheave is adapted to be translated along the length of the drive screw in both directions. The direction of travel of the carriage sheave may be reversed by use of a reversible drive means. In this arrangement, the drive screw may define a single helix male thread which engages a corresponding single helix female thread formed within the carriage sheave. In an alternative and preferred embodiment of the present invention, reversal of the direction of travel of the carriage sheave may be permitted by the provision of a double helix screw thread formed on the drive screw which engages a suitably formed follower mechanism provided with the carriage sheave, as is known in the art. In this way, the carriage sheave may be translated along the drive screw in opposing directions while the drive means and drive screw are continually operated or rotated in a single direction.

In use, the winch spooling assembly may conveniently be located adjacent a winch drum carrying a spoolable medium, wherein the carriage sheave engages the spoolable medium and is caused to be translated along the drive screw such that the carriage sheave follows the fleeting motion of the spoolable medium as the medium is paid out and/or in. It is therefore advantageous to align the spooling assembly parallel with the axis of rotation of the winch drum. Accordingly, the spooling assembly in operation permits the spoolable medium to continually exit the winch drum at an angle which is substantially perpendicular to the axis of rotation of the drum, providing an effective fleet angle of 0°, thus minimising the possibility of the spoolable medium becoming jammed or entangled, and permitting the spoolable medium to be properly wound onto the drum.

Preferably, the drive means is adapted to rotate the drive screw at a rate proportional to the rotation of an associated winch drum. Preferably, the proportional rate of rotation of the drive screw is such that the carriage sheave is caused to be translated at a linear velocity substantially equal to the fleeting rate of the spoolable medium along the length of the winch drum.

Advantageously, the drive means may comprises a motor coupled to the drive screw, wherein a control system is provided to maintain the motor at the required speed by monitoring the rotational velocity of the winch drum.

Alternatively, and in a preferred embodiment of the present invention, the drive means is a drive system comprising a power take off from an associated winch drum. Preferably, the drive means comprises a geared connection between a winch drum and the drive screw of the present invention. Accordingly, the drive screw is directly driven by an associated winch drum. Advantageously, the geared connection comprises a fixed ratio gear train such that the rotational speed of the drive screw is continually proportionate to the rotational speed of the winch drum. Preferably, the geared connection comprises directly meshing gear wheels. Alternatively, or additionally, the geared connection may comprise a chain drive or a belt drive or the like.

Preferably, the carriage sheave is adapted to engage a spoolable medium via a guide portion. Advantageously, the guide portion comprises at least one and preferably a plurality of rolling bodies to act as a bearing surface over which the spoolable medium runs. The rolling bodies may be ball bearings or rollers or the like. Beneficially, the guide portion is adapted to deflect the spoolable medium. Advantageously, the guide portion is adapted to deflect the spoolable medium through, for example, 0 to 180°, and preferably around 90°.

Preferably, the carriage sheave is adapted to be freely rotatable about the longitudinal axis of the drive screw such that the carriage may accommodate any changes in the relative inclination angle of the spoolable medium as it leaves the winch drum, which will vary as the spoolable medium in paid in and out thus increasing and decreasing, respectively, the effective diameter of the winch drum. Alternatively, the carriage sheave may be prevented from rotating about the longitudinal axis of the drive screw and may comprise a wide spoolable medium guide portion to accommodate variations in the inclination angle of the spoolable medium.

Advantageously, the spooling assembly is adapted for use within a subsea intervention system. Alternatively, the spooling assembly may be suitable for use at surface level, for example, on an offshore rig or intervention vessel or the like. Preferably, the spooling assembly is adapted for use in a pressure housing which may be exposed to wellbore pressures. Advantageously, the spooling assembly of the present invention is adapted to be aligned and operated in a substantially vertical plane. Preferably, the spooling assembly is adapted for use with wireline, such as slickline, braided line or some form of composite cable, or any suitable combination.

According to a third aspect of the present invention, there is provided a self-contained well intervention system for use with a well intervention tool, said system including a winch assembly according to the first aspect of the invention.

BRIEF DESCRIPTION OF THE DRAWINGS

These and other aspects of the present invention will now be described, by way of example only, with reference to the accompanying drawings, in which.

DETAILED DESCRIPTION OF THE DRAWINGS

Figure 1:
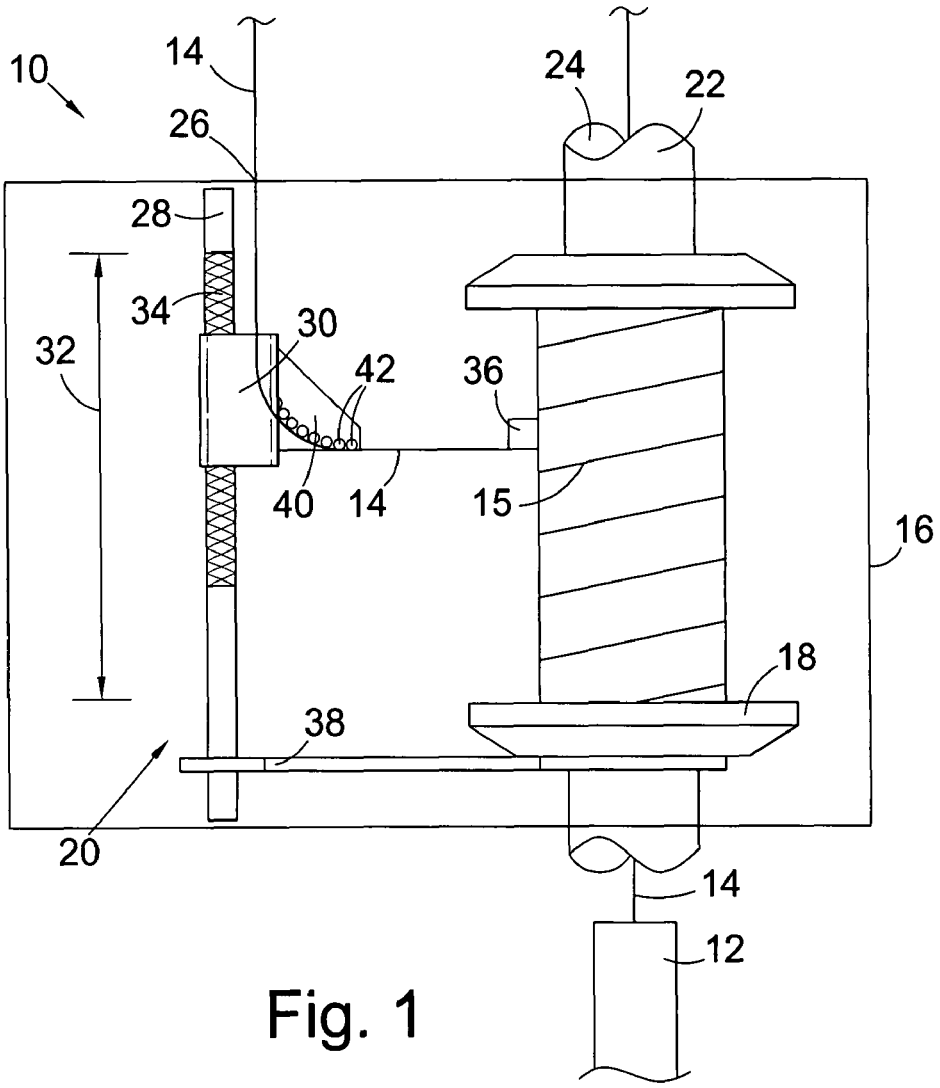
FIG. 1 is a diagrammatic representation of a winch assembly in accordance with an embodiment of an aspect of the present invention.

Reference is first made to FIG. 1 of the drawings which is a diagrammatic representation of a winch assembly, generally indicated by reference numeral 10, in accordance with an embodiment of the present invention. The winch assembly 10 forms part of a subsea well intervention system and is utilised to deploy, retrieve and optionally operate intervention tools, such as that shown generally at 12, in a wellbore (not shown) on wireline 14. The assembly 10 comprises a pressure housing 16 within which is located a winch drum 18 and a spooling mechanism 20. The wireline is wound onto the winch drum 18 in a conventional manner in suitably pitched coils 15.

The winch drum 18 is vertically mounted on a tubular body 22 which defines a throughbore 24, through which throughbore 24 the wireline 14 and associated tool 12 may extend, into and out of the wellbore. In use, the wireline 14 exits the pressure housing 16 at location 26, extends upwardly through a first lubricator tube (not shown), passes through an upper sheave (not shown), and extends downwardly through a second lubricator tube (not shown) and through the throughbore 24 of the tubular member 22. Accordingly, the pressure housing is exposed to wellbore pressure via tubular 22 and the lubricator tubes.

The spooling mechanism 20 comprises a drive leadscrew 28 upon which there is mounted a carriage sheave 30 which in use engages the wireline 14. The carriage sheave 30 is adapted to be translated along the length of the leadscrew 28 in forward and reverse directions, as represented by arrows 32, by the provision of a double helix screw thread 34 on the leadscrew 28, and a suitable follower mechanism (not shown) on the carriage sheave 30. Such a double helix thread and follower mechanism is generally known and as such will not be described herein in further detail. In use, the carriage sheave 30 engages the wireline 14 and is caused to be translated along the leadscrew 28 such that the carriage sheave 30 follows the fleeting motion of the wireline 14 as it is paid out and/or in from the winch drum 18. Accordingly, the winch assembly 10, in operation, permits the wireline 14 to continually exit the winch drum 18 at an angle 36 which is substantially perpendicular to the axis of rotation of the drum 18, thus minimising the possibility of the wireline 14 becoming jammed or entangled, and permitting the wireline 14 to be properly wound onto the winch drum 18 in coils 15.

The winch drum 18 is driven by a motor (not shown) and suitable gearing (also not shown). A geared connection 38 is provided between the winch drum 18 and the leadscrew 28 such that the leadscrew 28 is directly driven by the winch drum 18. The geared connection 38 comprises a fixed ratio gear train such that the rotational speed of the leadscrew 28 is continually proportional to the rotational speed of the winch drum 18. In this way, the carriage sheave 30 will be caused to be translated at a linear velocity substantially equal to the fleeting rate of the wireline 14 along the length of the winch drum 18; the fleeting rate will be dictated by the speed of rotation of the winch drum 18 and the pitch spacing of the coils 15 of wireline 14.

The carriage sheave 30 includes a wireline guide portion 40 which engages the wireline 14, wherein the guide portion comprises a plurality of rolling bodies 42 which act as a bearing surface over which the wireline 14 runs. As shown in FIG. 1, the wireline guide 40 deflects the wireline through 90°.

Figure 2:
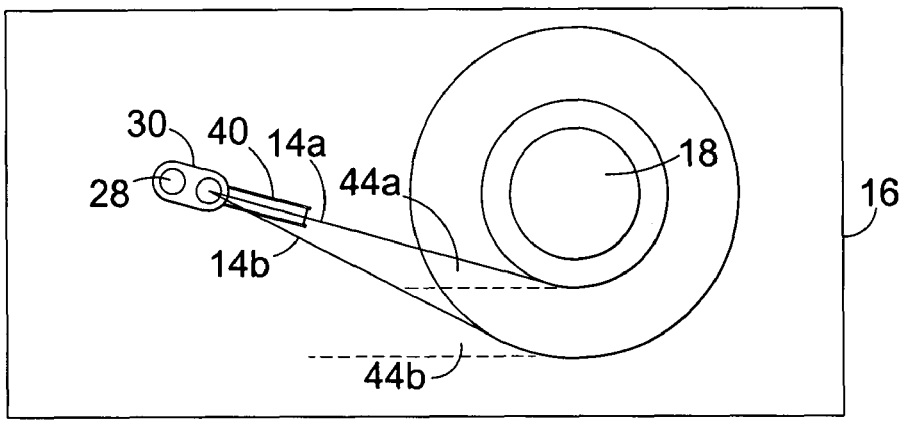
FIG. 2 is a diagrammatic representation of the winch assembly of FIG. 1, viewed from the bottom.

Reference is now additionally made to FIG. 2 which is a diagrammatic representation of the winch assembly 10 of FIG. 1, viewed from the bottom. In the embodiment shown, the carriage sheave 30 is freely rotatable about the longitudinal axis of the leadscrew 28 such that the carriage sheave 30 may accommodate any changes in the relative inclination angle of the wireline as it extends from the winch drum 18. For example, when a large quantity of wireline 14*a* (FIG. 2) is paid out from the winch drum 18, a relatively small effective winch drum diameter is produced with a relatively small wireline inclination angle 44*a*. However, when the wireline 14*b* (FIG. 2) is paid in, this produces a relatively large effective winch drum diameter with a corresponding increased wireline inclination angle 44*b*.

It should be understood that the embodiment described herein is merely exemplary of the present invention and that various modifications may be made thereto without departing from the scope of the invention. For example, the winch assembly may be utilised at surface level such as on an offshore rig or suitable intervention vessel. Additionally, the leadscrew 28 may alternatively be driven by a separate motor, which motor may be capable of being readily reversed, thus eliminating the requirement to utilise a double helix screw thread. Furthermore, the carriage sheave 30 may be rotationally fixed with respect to the longitudinal axis of the leadscrew. The carriage sheave may include a relatively wide wireline guide portion or a V-shaped portion which accommodates variations of wireline inclination angle.

The present invention is particularly advantageous in that it substantially minimises the possibility for the wireline to become entangled within the subsea intervention system, which otherwise may require the entire subsea system to be disconnected from the wellhead and returned to the surface for repair. Additionally, the vertical orientation of the winch assembly 10 of the present invention permits a more efficient use of space, resulting in a more compact and even lighter subsea system.

The invention claimed is:

1. A winch assembly for use with a spoolable medium, said assembly comprising:

a winch drum rotatable about a first axis and adapted to carry a spoolable medium, the winch drum being adapted to be coupled to drive means comprising a motor for rotatably driving the winch drum to spool the spoolable medium;

a drive screw rotatable about a second axis aligned substantially parallel with the first axis;

a carriage sheave mounted on the drive screw and adapted to be translated by the drive screw axially therealong, said carriage sheave further adapted to engage the spoolable medium, the drive screw being adapted to be coupled to drive means comprising a motor for rotatably driving the drive screw to translate the carriage sheave therealong; and a control system for maintaining the drive screw motor at the required speed by monitoring the speed of the winch drum motor.

2. The winch assembly of claim 1, wherein the carriage sheave is adapted to be translated along the length of the drive screw in both directions.

3. The winch assembly of claim 1 wherein the direction of travel of the carriage sheave may be reversed by use of a reversible drive means.

4. The winch assembly of claim 3, wherein reversal of the direction of travel of the carriage sheave is permitted by a double helix screw thread formed on the drive screw which engages a follower mechanism provided with the carriage sheave.

5. The winch assembly of claim 1, wherein the drive screw defines a single helix male thread which engages a corresponding single helix female thread formed within the carriage sheave.

6. The winch assembly of claim 1, wherein, in use, the carriage sheave engages the spoolable medium and is caused to be translated along the drive screw such that the carriage sheave follows the fleeting motion of the spoolable medium.

7. The winch assembly of claim 6, wherein the winch assembly, in operation, permits the spoolable medium to continually exit the winch drum at an angle which is substantially perpendicular to the axis of rotation of the drum, providing an effective fleet angle of 0°.

8. The winch assembly of claim 1, wherein the drive means is adapted to rotate the drive screw at a rate proportional to the rotation of the winch drum.

9. The winch assembly of claim 8, wherein the proportional rate of rotation of the drive screw is such that the carriage sheave is caused to be translated at a linear velocity substantially equal to the fleeting rate of the spoolable medium along the length of the winch drum.

10. The winch assembly of claim 1, further comprising a secondary drive means to be operated as a back-up system.

11. The winch assembly of claim 1, wherein the carriage sheave is adapted to engage the spoolable medium via a guide portion.

12. The winch assembly of claim 11, wherein the guide portion comprises at least one rolling body to act as a bearing surface over which the spoolable medium runs.

13. The winch assembly of claim 11, wherein the guide portion is adapted to deflect the spoolable medium.

14. The winch assembly of claim 13, wherein the guide portion is adapted to deflect the spoolable medium through 0° to 180°.

15. The winch assembly of claim 13, wherein the guide portion is adapted to deflect the spoolable medium through around 90°.

16. The winch assembly of claim 1, wherein the carriage sheave is mounted on the drive screw so as to be freely rotatable about the second axis.

17. The winch assembly of claim 1, wherein the carriage sheave comprises a wide spoolable medium guide portion.

18. The winch assembly of claim 1, adapted for use within a subsea intervention system.

19. The winch assembly of claim 1, further comprising a pressure retaining enclosure, within which enclosure at least the winch drum, drive screw and carriage sheave are mounted.

20. The winch assembly of claim 19, wherein the pressure retaining enclosure is adapted to be connected to a wellhead such that the spoolable medium may be extended from the winch assembly to the wellhead, and into a wellbore.

21. The winch assembly of claim 20, wherein the spoolable medium extends between the pressure retaining enclosure and the wellhead via one or more lubricator tubes.

22. The winch assembly of claim 20, wherein the pressure retaining enclosure is adapted to be exposed to and retain wellbore pressures.

23. The winch assembly of claim 19, wherein the pressure retaining enclosure forms part of a subsea intervention system.

24. The winch assembly of claim 19, further comprising a slip ring/collector.

25. The winch assembly of claim 24, wherein the slip ring/collector is provided between the winch drum and the pressure retaining enclosure.

26. The winch assembly of claim 1, adapted to be positioned in a vertical position such that the first and second axes are substantially vertical.

27. The winch assembly of claim 1, wherein the winch drum is adapted to be mounted on a tubular body defining a throughbore extending towards a wellhead and through which throughbore the spoolable medium extends, in use, from the winch drum and into the wellbore.

28. The winch assembly of claim 1, wherein the winch drum defines spiral grooves on a barrel surface thereof to ensure correct spooling of the spoolable medium.

29. The winch assembly of claim 1, wherein the winch drum is adapted to accommodate a variety of spoolable media.

30. A self contained well intervention system for use with a well intervention tool, said system including a winch assembly according to claim 1.

* * * * *